US005170590A

United States Patent [19]

Sato et al.

[11] Patent Number: 5,170,590

[45] Date of Patent: Dec. 15, 1992

[54] METHOD OF SUPERFINISHING A GOTHIC-ARCH GROOVE

[75] Inventors: Chuichi Sato; Yoshimitsu Suganuma, both of Fujisawa, Japan

[73] Assignee: Nippon Seiko Kabushiki Kaisha, Tokyo, Japan

[21] Appl. No.: 610,009

[22] Filed: Nov. 7, 1990

[30] Foreign Application Priority Data

Nov. 7, 1989 [JP] Japan ..... 1-288994

[51] Int. Cl.[5] ..... B24B 1/00

[52] U.S. Cl. ..... 51/288; 409/66

[58] Field of Search ..... 51/281 R, 288, 94 CS, 51/95 TG, 99, 287, 326, 327; 409/66, 74, 76, 77, 131, 132

[56] References Cited

U.S. PATENT DOCUMENTS 4,860,501 8/1989 Belthe ..... 51/288

5,088,244 2/1992 Shirakura et al. ..... 51/288

FOREIGN PATENT DOCUMENTS 34-17521 10/1981 Japan .

*Primary Examiner*—Bruce M. Kisliuk

*Assistant Examiner*—John A. Marlott

*Attorney, Agent, or Firm*—Basile and Hanlon

[57] ABSTRACT

In superfinishing a Gothic-arch-shaped groove of a nut by using a superfinishing stone attached to the tip end of an oscillation arm while oscillating the superfinishing stone about the oscillation axis and, at the same time, moving the superfinishing stone in the longitudinal direction of the Gothic-arch groove, the oscillation axis is inclined by a predetermined angle with respect to the longitudinal direction of the Gothic-arch groove. The shape of the cross section of the Gothic-arch groove orthogonal to the oscillation axis is regarded as a single circular arc and, thus, both flanks of the Gothic-arch groove can be superfinished simultaneously.

5 Claims, 8 Drawing Sheets

METHOD OF SUPERFINISHING A GOTHIC-ARCH GROOVE

BACKGROUND OF THE INVENTION

1. Field of the Invention

The present invention relates to a method of simultaneously superfinishing a left and a right flank of a Gothic-arch groove of a ball thread, a linear movement guide bearing, a ball bearing, or the like in which balls roll.

In this respect, the Gothic-arch groove means a groove whose cross section orthogonal to the groove has a shape in which the centers of identical circular arcs of right and left flanks are offset.

2. Description of the Prior Art

In the prior art, generally, the Gothic-arch groove, which is a groove for balls to roll therein, of a ball screw, a linear movement guide bearing, a ball bearing, or the like has only been finished by grinding and has not been worked by superfinishing.

Furthermore, it has been known to work the superfinishing only on a surface portion of the Gothic-arch groove in the vicinity of a contact point of the ball used therein without working the whole surface of the groove.

In this prior art method, as shown in FIG. 13, in a Gothic-arch groove formed by offsetting a center $O_R$ of a circular arc having a radius R of a right flank 1 from a center OL of a circular arc having the same radius R of a left flank 2 in a horizontal direction by a distance a, an intersection point $O_B$ of straight lines respectively drawn from the centers $O_R$ and $O_L$ at an angle of 45 degrees with respect to the horizontal direction is the center of a ball 3 used therein, and the intersections $P_R$ and $P_L$ of the straight lines and the right flank 1 and the left flank 2, respectively, are the contact points of the ball 3 with the right flank 1 and the left flank 2. A superfinishing stone 4 having a radius larger than the radius of the ball 3 and smaller than the radius R of the groove is oscillated about an oscillation axis passing through the center $O_B$ of the used ball 3 and perpendicular to the drawing to thereby work the superfinishing on the vicinity to the fulcrums $P_R$ and $P_L$ of the Gothic-arch groove With respect to the used ball 3.

In this case, the reason for the use of the superfinishing stone 4 having the radius of its cross section larger than the radius of the ball 3 and smaller than the radius of the right and left flanks 1 and 2 is that fitness during the progress of the superfinishing is taken into consideration.

However, in the prior art superfinishing method of the Gothic-arch groove, the superfinishing is worked primarily in the vicinity of the contact points of the ball with respect to the groove, and the whole surface of the Gothic-arch groove is not worked uniformly. As a result, the radius size of the groove and the amount of offset which have been formed in a previous process (cutting work) are changed in the superfinishing, and the shape of the curved groove is degraded and the roughness of the surface becomes nonuniform. Thus, a problem is involved in that the evaluation of a value of the radius size of the groove after the superfinishing work becomes difficult.

SUMMARY OF THE INVENTION

The present invention was made in view of the problem in the prior art method and it is an object of the invention to provide a method of superfinishing a Gothic-arch groove in which the whole of the Gothic-arch groove is superfinished uniformly, the radius size of the groove and the amount of offset are not altered, the roughness of the surface is uniform, and the value of the radius size of the groove after the superfinishing is equal to a desired value.

In the method of superfinishing a Gothic-arch groove in the present invention, a superfinishing stone is moved along a longitudinal direction or a lead direction of the Gothic-arch groove of a nut or a male screw having a ball screw, a linear movement guide bearing, a ball bearing, or the like while the superfinishing stone is pressed against the Gothic-arch groove. The superfinishing stone is oscillated about an oscillation axis which is inclined by a predetermined oscillation axis angle with respect to the longitudinal direction. At this time, the oscillation axis angle is selected to be an angle at which a shape of the Gothic-arch groove in a cross section orthogonal to the oscillation axis is regarded as a single circular arc with a minimum error. As a result, both flanks of the Gothic-arch groove can be superfinished by the oscillation of the superfinishing stone with a uniform removing quantity.

DESCRIPTION OF THE PREFERRED EMBODIMENTS

Figure 1:
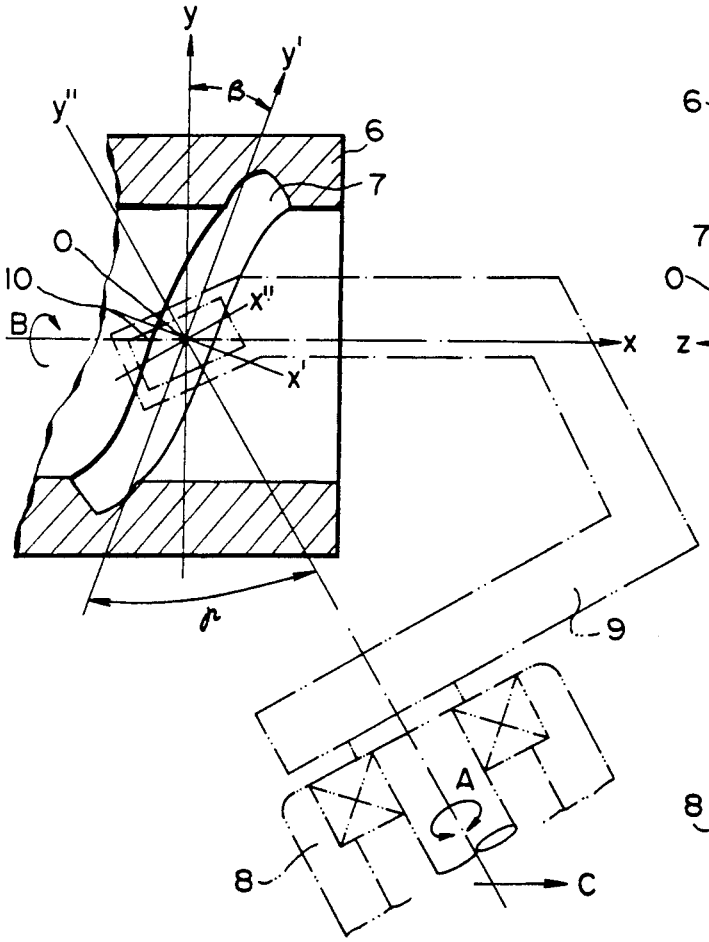
FIG. 1 is a plan view with a main part in cross section illustrating an embodiment of a method of superfinishing a Gothic-arch groove of the present invention in which the method is applied to a nut having a ball screw.
Figure 2:
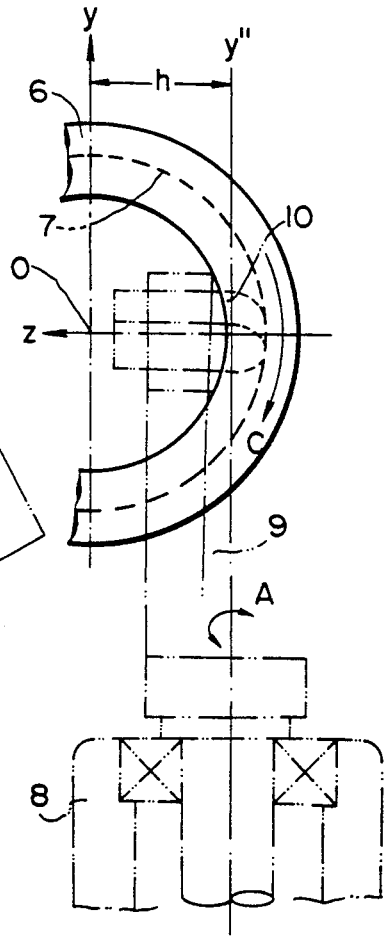
FIG. 2 is a right side elevational view of the nut shown in FIG. 1.
Figure 13:
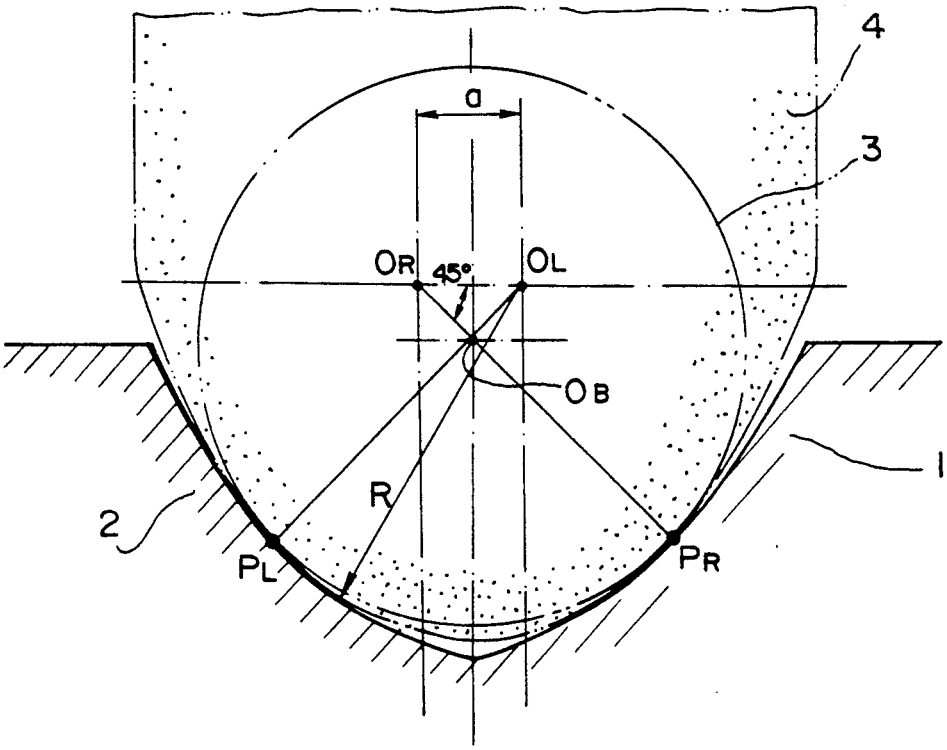
FIG. 13 PRIOR ART
FIG. 13 is a cut plan view useful for explaining a prior art superfinishing method of the Gothic-arch groove.

An apparatus for implementing a method of superfinishing a Gothic-arch will be explained. With reference to FIGS. 1 and 2, a center axis of a nut 6 having a ball screw and attached to a chuck (not shown) is represented by x, a horizontal axis passing through a point 0 on the center axis x is represented by y, and a vertical axis is represented by z. The nut 6 is formed with a Gothic-arch groove 7 with a lead angle $\beta$ at the point $O_B$ in FIG. 13 with respect to the horizontal axis y. The shape of a cross section orthogonal to a line x' which is perpendicular to a longitudinal direction (i.e., a lead direction) y' and which passes through the point O has the above-mentioned Gothic-arch shape.

In FIG. 1, an oscillation axis which passes through the point O and which is inclined by an oscillation axis angle $\gamma$ with respect to the thread axis y' is represented by y''. This oscillation axis y'' is positioned as shown in FIG. 2 below the point O by a distance h in a direction z. An oscillation spindle 8 which oscillates about the oscillation axis y'' is disposed near the nut 6, and a superfinishing stone 10 is mounted on a tip end of an oscillation arm 9 which is fixed to the spindle shaft 8. As a result, the superfinishing stone 10 is able to oscillate about the oscillation axis y'' in a direction A with a radius r (shown in FIG. 3). Furthermore, the nut 6 is rotated about the axis x in a direction B and in synchronism with the rotation, that is, for each one rotation of the nut 6, the oscillation spindle 8 and the oscillation arm 9 and the superfinishing stone 10 are moved by one lead 1 in a direction C in parallel to the axis x. Also, although not shown, the superfinishing stone 10 is pressed against the Gothic-arch groove 7 of the nut 6 by a superfinishing stone pressing device provided on a part of the oscillation arm 9.

Figure 3:
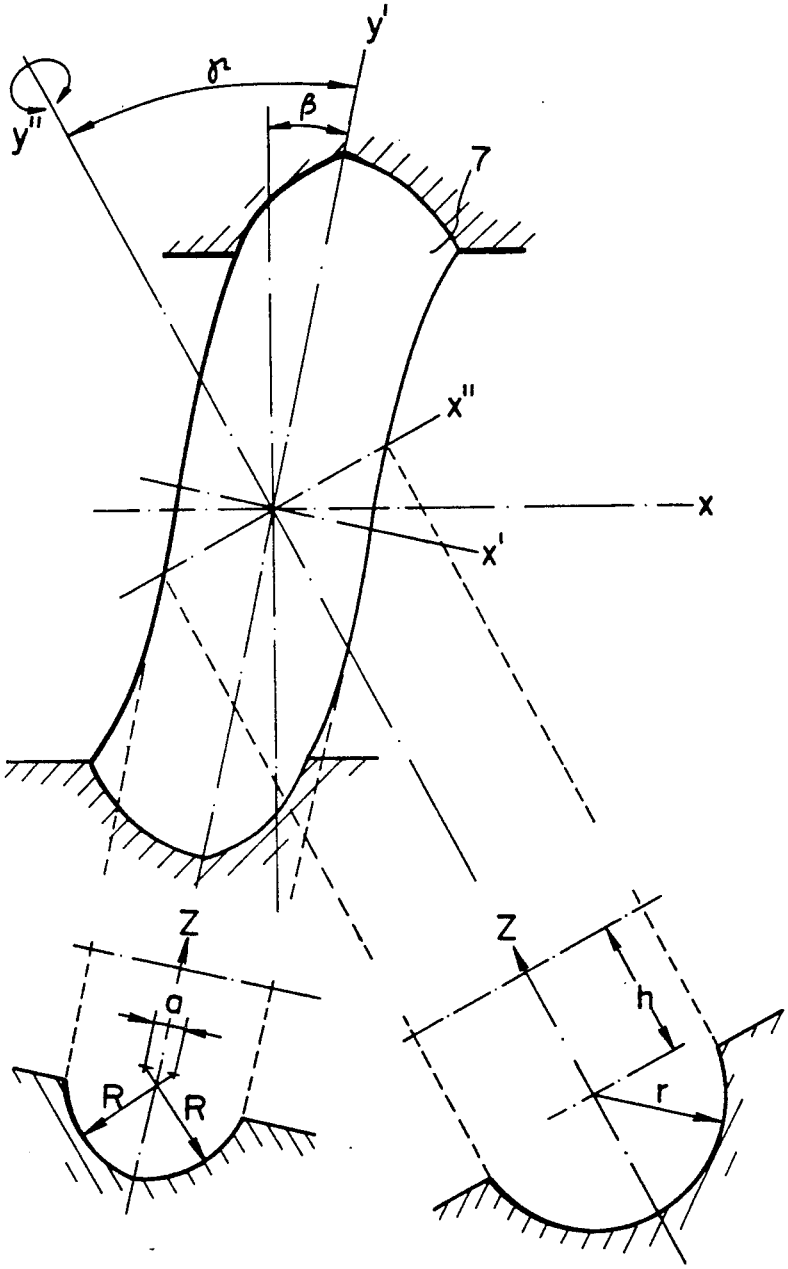
FIG. 3 is a diagram for explaining the principle of the embodiment shown in FIG. 1.

As shown in FIG. 3, the shape of a cross section of the Gothic-arch groove 7 taken along a line x'' orthogonal to the oscillation axis y'' which is inclined by the oscillation axis angle $\gamma$ with respect to the lead direction y' of the Gothic-arch groove 7 can be regarded as a single circular arc approximately over the whole cross section.

In operation of the apparatus described above, with reference to FIGS. 1 to 3, when the nut 6 is rotated in the direction B, in synchronism with the rotation, the oscillation spindle 8 is moved in the direction C When the oscillation spindle 8 oscillates in the direction A, the superfinishing stone 10 is oscillated about the oscillation axis y'' while the superfinishing stone 10 is pressed against the Gothic-arch groove 7 of the nut 6 by the superfinishing stone pressing device provided on the oscillation arm 9. Thus, both the right and left flanks of a surface of the Gothic-arch 7 are superfinished simultaneously.

At this time, the oscillation axis y'' of the superfinishing stone 10 is inclined by the oscillation axis angle $\gamma$ with respect to the lead direction y' of the Gothic-arch 7 and the superfinishing stone 10 performs superfinishing with the radius r and with an oscillation center positioned below the point O of the axis z by the distance h. Accordingly, the shape of the cross section of the Gothic-arch 7 taken along the line x'' orthogonal to the oscillation axis y'' can be regarded as a single circular arc with a minimum error. Thus, the whole of the groove 7 can be superfinished with a uniform removing quantity.

Next, the manner of obtaining the oscillation axis angle $\gamma$, the position h in the direction z, and the radius r of the superfinishing stone 10 will be described.

Figure 5A:
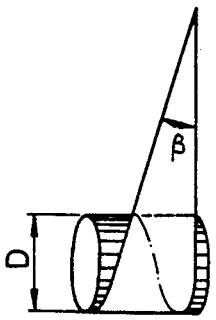
FIGS. 5A and 5B show a relationship between a center line and a peripheral length of the thread.
Figure 5B:
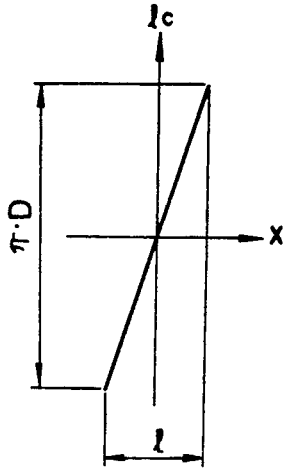
Figure 4:
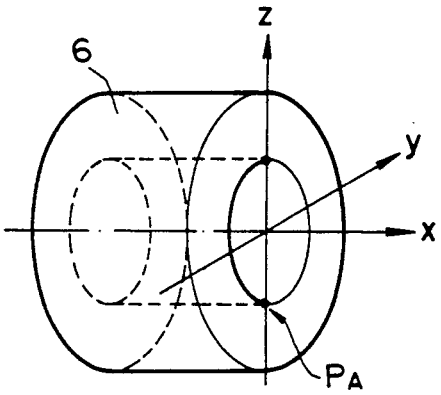
FIG. 4 is a perspective view showing the coordinates of the nut.

As shown in FIG. 4, the axis x, the axis y, and the axis z are specified on the nut 6. A point $P_A$ is a working position. Further, in FIGS. 5A and 5B, in a thread line having a lead angle $\beta$, a peripheral length $1_c$ with respect to the axis x is expressed by the following equation:

$$l_c = \frac{\pi \cdot D}{l} X \tag{1}$$

where D is the diameter of the thread line, and l is the lead of the thread line.

Figure 6:
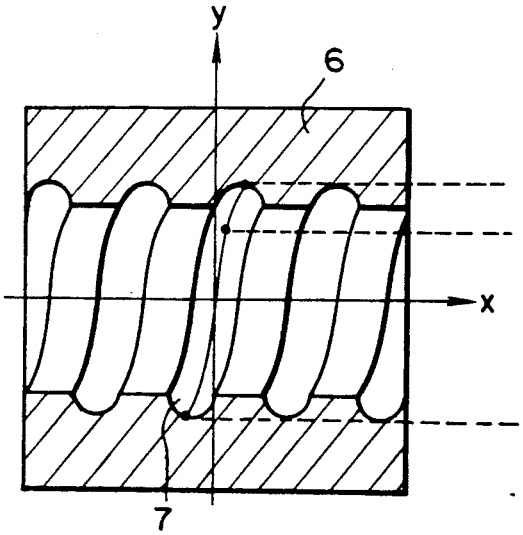
FIG. 6 is a cut plan view of the nut and the Gothic-arch groove.
Figure 7:
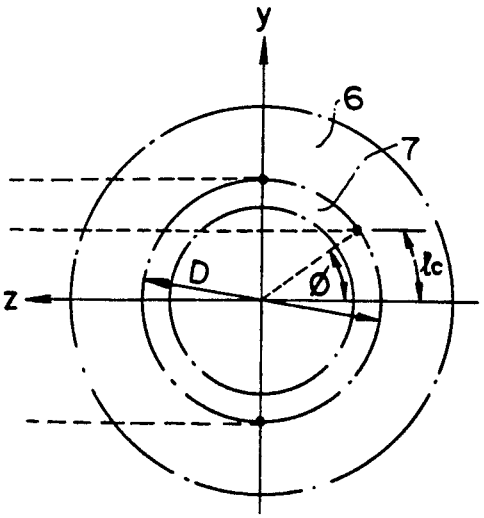
FIG. 7 is a right side elevational view of FIG. 6.

Further, in FIGS. 6 and 7, when an angle of circumference containing the peripheral length $1_c$ is represented by $\phi$, the following equations are established:

$$y = \frac{D}{2} \sin \phi \tag{2}$$

$$\phi = \frac{2 \cdot l_c}{D} \tag{3}$$

From the equations (1) to (3) the equation of an orthogonal projection curve (hereinafter referred to as a torsion curve) of an arbitrary thread line is as follows:

$$y = \frac{D}{2} \sin\left(\frac{2\pi X}{l}\right) \tag{4}$$

Next, a ball groove of an actual ball screw nut will be considered. Since the right and left flanks of the groove are symmetrical, only one flank (e.g., the right flank) may be considered.

Figure 8:
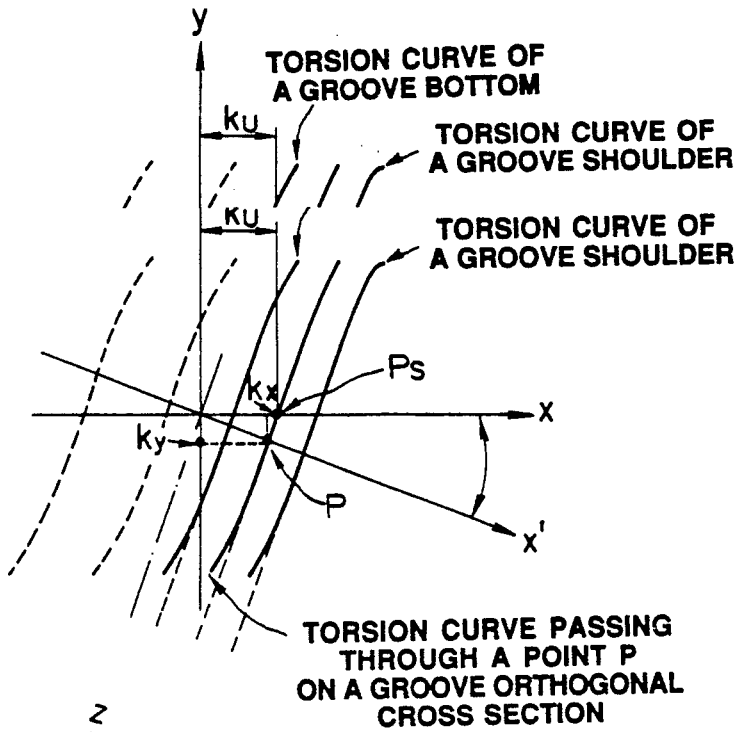
FIG. 8 is a plan view showing various torsion curves.
Figure 9:
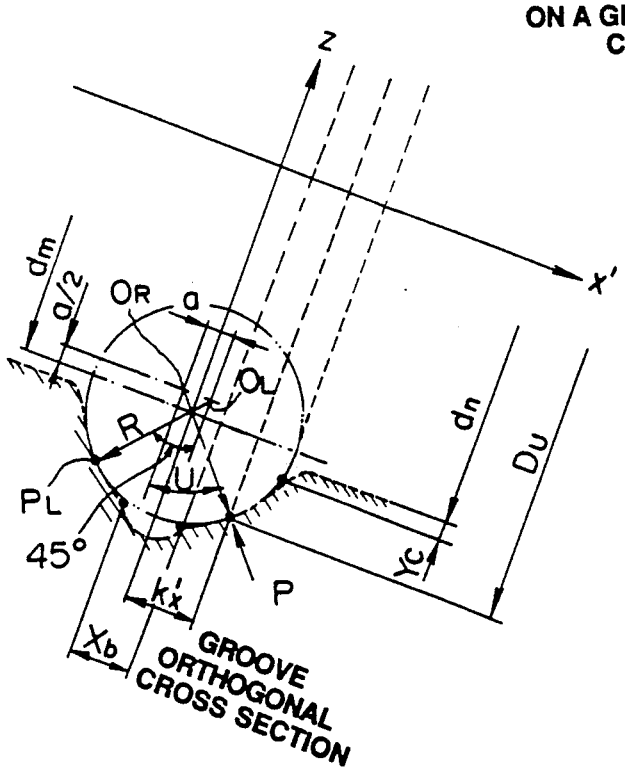
FIG. 9 is a cross sectional view taken along the line x' in FIG. 8.

With reference to FIGS. 8 and 9, each of the coordinates x, x', y, and z, and various symbols are defined as shown in FIGS. 8 and 9. Here, 1 represents a lead, dm represents the diameter of a locus of rolling movement of the center of the used ball 3, $\beta$ represents a lead angle, dn represents an inner diameter of the nut 6, $\alpha$ represents the amount of offset, R represents a radius of the groove, $X_b$ represents the width of a relief recess and $Y_c$ represents the height of chamfer.

Where the point P represents a point on the groove at an arbitrary angle U on a cross section orthogonal to the groove (referred to as a groove orthogonal cross section) in an x' - z plane, the point P represents a point at which a torsion curve of a thread line passing through the point P intersects the x axis, and $k_u$ represents the distance of the point $P_s$ from the y axis, the equation of the torsion curve of the thread line passing through the point P is expressed from the equation (4) as follows:

$$y = \frac{D_u}{2} \sin\left[\frac{2 \cdot \pi}{l}(x - k_u)\right] \tag{5}$$

Here, $D_u$ is the diameter of the thread line passing through the point P on the groove.

A distance $k'_x$ of the point P on the groove in the groove orthogonal cross section from the axis z is expressed by the following equation:

$$k'_x = R \cdot \sin U - \frac{a}{2} \tag{6}$$

Further, the diameter $D_u$ of the thread line passing through the point P is expressed by the following equation:

$$D_u = dm - a + 2.R.\cos U \tag{7}$$

On the other hand, where the coordinates of the point P on the x - y plane are represented by ($k_x$, $k_y$), $k_x$ is expressed by:

$$k_x = k'_x \cdot \cos\beta \tag{8}$$

$$k_y = k'_x \cdot \sin\beta \tag{9}$$

Accordingly, a value of $k_u$ in the equation of the torsion curve of the thread line passing through the point P is obtained by substituting the equations (6), (7), (8), and (9) to the equation (5) as follows:

$$\begin{aligned} k_y &= \frac{D_u}{2} \sin\left[\frac{2\cdot\pi}{l}(k_x - k_u)\right] \\ k_u &= k_x - \frac{l}{2\cdot\pi}\sin^{-1}\frac{2\cdot k_y}{D_u} \\ &= \left(R\cdot\sin U - \frac{a}{2}\right)\cdot\cos\beta - \\ &\quad \frac{l}{2\pi}\sin^{-1}\frac{2\left(R\cdot\sin U - \frac{a}{2}\right)\cdot\sin\beta}{dm - a + 2R\cdot\cos U} \end{aligned} \tag{10}$$

Therefore, the torsion curve of the thread line passing through the point P on the groove at the arbitrary angle U on the groove orthogonal cross section can be expressed by the equations (5), (7), and (10). However, the following relations are satisfied:

$$k_u - \frac{l}{4} \leqq x \leqq k_u + \frac{l}{4} \tag{11}$$

$$\sin^{-1}\frac{X_D + a}{2\cdot R} \leqq U \leqq \cos^{-1}\frac{a + 2\cdot Y_c + d_n - d_m}{2\cdot R} \tag{12}$$

Figure 10:
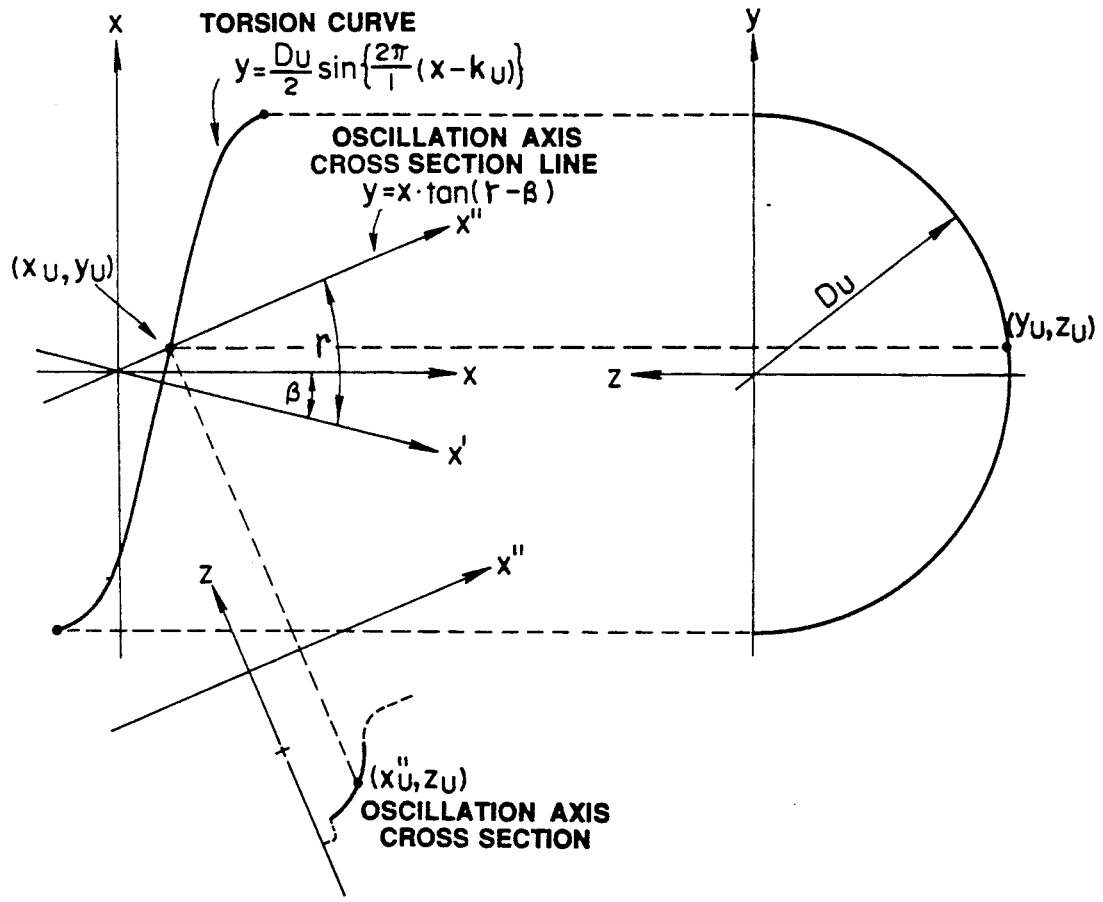
FIG. 10 is a diagram useful for explaining a manner of calculating the shape of cross section orthogonal to an oscillation axis of the nut.

As shown in FIG. 10, in the x - y plane, where an intersection point between each torsion curve and an oscillation axis cross section line (x'' axis) is represented by ($x_u$, $y_u$), this intersection point is obtained as a value of the solution of a simultaneous equation with two unknowns of the equation (5) of the torsion curve and an equation expressing the oscillation axis cross section line, that is:

$$y = x.\tan(\gamma - \beta). \tag{13}$$

The coordinates ($x''_u$, $z_u$) of each point on an oscillation axis cross section (x'' - z plane) are expressed by the following equation:

$$\left.\begin{aligned} x''_u &= \sqrt{X_u^2 + Y_u^2} \\ Z_u &= -\sqrt{\frac{D_u^2}{4} - Y_u^2} \end{aligned}\right] \tag{14}$$

Thus, the shape of the oscillation axis cross section can be obtained by calculating ($x''_u$, $z_u$) from the equation (14) at each of the angle U on the groove orthogonal cross section and by plotting the calculated results.

Figure 11:
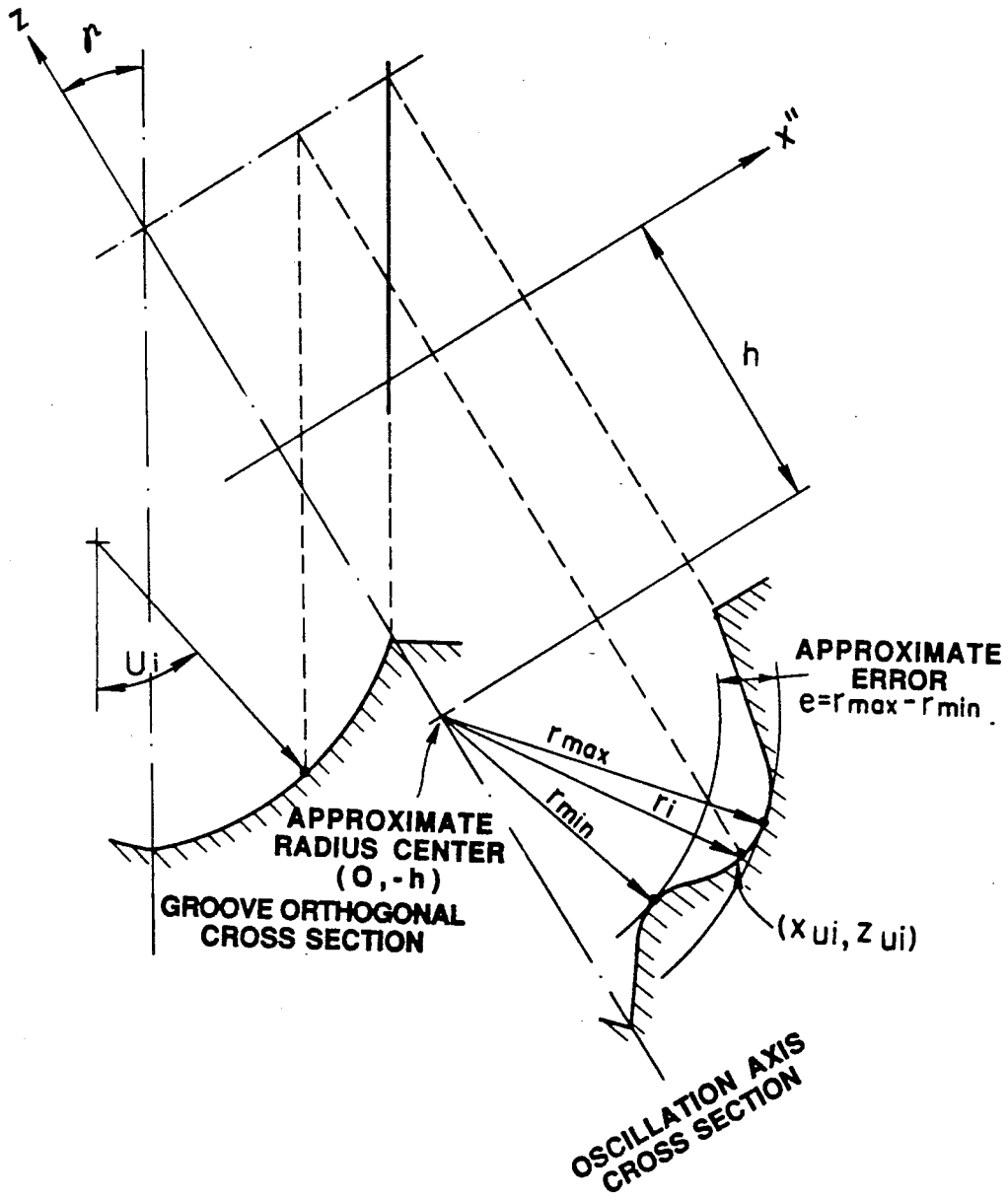
FIG. 11 is a diagram showing a method of approximating an optimum single circular arc in a cross section orthogonal to the oscillation axis of the nut.

Furthermore, in the oscillation axis cross section, as shown in FIG. 11, an oscillation center (O, - h) of the superfinishing stone having an approximate radius r is obtained on the y'' axis and, with respect to a point ($x''_{ui}$, $Z_{ui}$) on the oscillation axis cross section corresponding to an angle $U_i$ (i=1, 2, . . . , n), a radius from each approximate center is represented by $r_i$. In an optimum circular arc approximation, a superfinishing stone oscillation angle $\gamma$ and a height h of the center and a superfinishing stone radius r at which a value of a circular arc approximate error ($e = r_{max} - r_{min}$) in an approximate radius becomes minimum are obtained by use of a computer.

In an example of the calculation, a single circular arc could be approximated with an approximate error of 1.5 μm in a range of the ball contact point of ±10 degrees (U) which are most important and at an oscillation axis angle of 24.2 degrees. This value in such a degree of accuracy is sufficiently satisfactory and, also, in an actual working, the accuracy of the groove shape comparable to the calculated value was obtained.

In this respect, the groove shape in the oscillation axis cross section in FIG. 11 is shown by enlarging the error.

Figure 12:
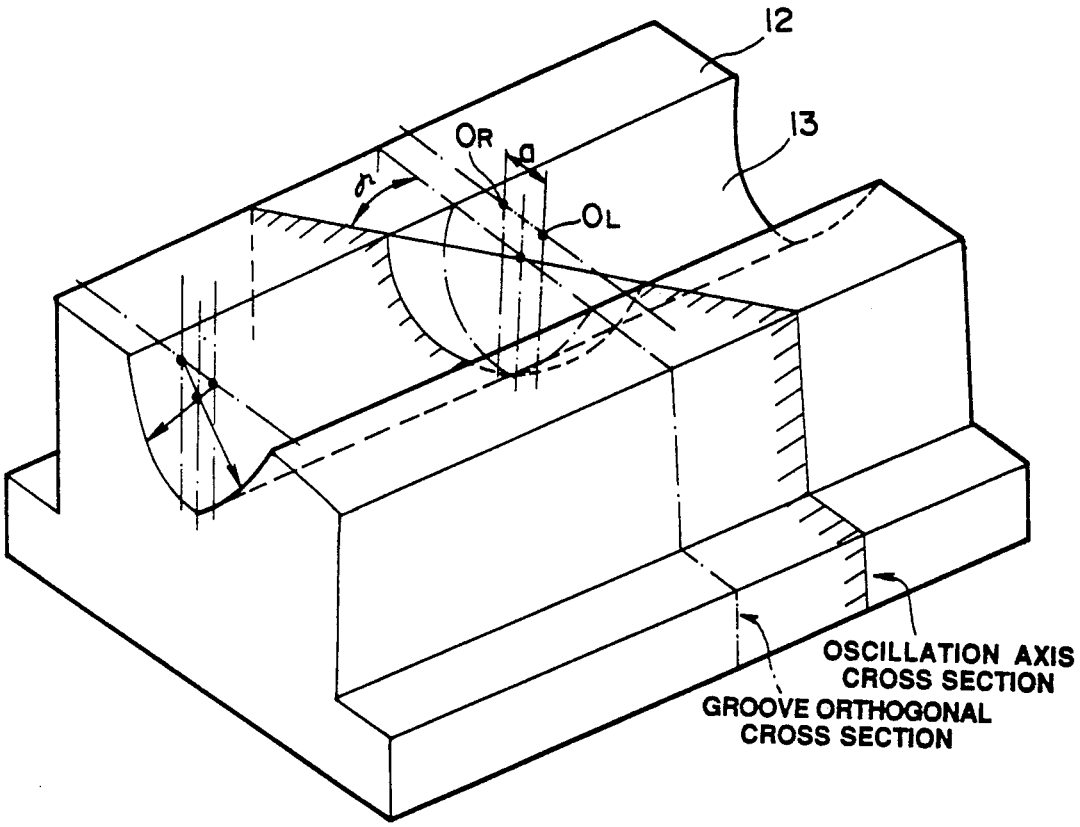
FIG. 12 is a perspective view in which another embodiment of the present invention is applied to a linear movement guide bearing.

FIG. 12 shows another embodiment in which the method of the present invention is applied to a linear movement guide bearing.

In this linear movement guide bearing 12, a superfinishing stone is moved reciprocatingly along a longitudinal direction of a Gothic-arch groove 13 while the superfinishing stone is pressed against the groove 13 with a predetermined force and oscillated in an oscillation axis orthogonal cross section which is inclined by an oscillation axis angle $\gamma$ with respect to a groove orthogonal cross section. In this oscillation axis orthogonal cross section, the Gothic-arch groove can be regarded as a single circular arc with a minimum error and the oscillation axis angle $\gamma$ of the superfinishing stone, a height h of the oscillation center, and a radius r of the superfinishing stone can be obtained by a similar procedure using the calculation described above.

In the embodiments described above, the method is described as applied to the nut having the ball screw and the linear movement guide bearing. However, the present invention is also applicable to a Gothic-arch groove of a male screw having a ball screw, a ball bearing, or the like. In the case of the male screw, the structure of an apparatus is substantially similar to the case of the female screw. In the case of the ball bearing, the reciprocating movement of the superfinishing stone is not required and it is only necessary to rotate the ball bearing or the superfinishing stone in a direction along the Gothic-arch groove.

Furthermore, the calculation of an optimum circular arc approximation for the oscillation of the superfinishing stone can be similarly performed.

As described in the foregoing, in the superfinishing method of the Gothic-arch groove of the present invention, the superfinishing stone is oscillated about the oscillation axis which is inclined by a predetermined oscillation axis angle with respect to the axis direction of the Gothic-arch groove. Because the shape of the Gothic-arch groove in the cross section orthogonal to the oscillation axis can be regarded as a single circular arc with a minimum error, the superfinishing of both flanks of the Gothic-arch groove can be performed at the same time with a constant removing quantity. Thus, advantages are provided in that the groove shape is not degraded, the radius size of the groove and the amount of offset are not altered, and a uniformly superfinished surface can be obtained.

What is claimed is:

1. A method of superfinishing a Gothic-arch groove after the groove has been ground, the method comprising the steps of:

carrying out the superfinishing by means of a superfinishing stone which is oscillated alternately in opposite directions about an oscillation axis;

inclining the oscillation axis of the superfinishing stone by a predetermined angle in a horizontal plane with respect to a longitudinal direction of the Gothic-arch groove, the predetermined angle being determined so that the shape of the Gothic-arch groove in a cross section orthogonal to the oscillation axis is regarded as a single circular arc with a minimum error;

displacing the inclined oscillation axis in parallel along a vertical axis of the horizontal plane so that the oscillation axis passes through a center of the single circular arc; and oscillating the superfinishing stone about the inclined and displaced oscillation axis while moving the superfinishing stone along the longitudinal direction to simultaneously superfinish both flanks of the Gothic-arch groove.

2. The method of superfinishing a Gothic-arch groove as defined in claim 1 wherein the Gothic-arch groove is formed as a female thread in a nut, and wherein the horizontal plane is defined by a longitudinal axis and its orthogonal axis, the method further comprising the step of:

passing the oscillation axis through, on the vertical axis, the center of the single circular arc, the center being located at a position lowered by a predetermined distance from an origin of the horizontal plane.

3. The method of superfinishing a Gothic-arch groove as defined in claim 1 wherein the Gothic-arch groove is formed as a male thread of a ball screw, the method further comprising the step of:

passing the oscillation axis through the center of the single circular arc, the center being located at a position raised by a predetermined distance from an origin of the horizontal plane.

4. The method of superfinishing a Gothic-arch groove as defined in claim 1 wherein the Gothic-arch groove is formed as a groove of a linear guide bearing, and wherein the horizontal plane is defined by a longitudinal axis and its orthogonal axis, the method further comprising the step of:

passing the oscillation axis through the center of the single circular arc, the center being located at a position raised or lowered by a predetermined distance from an origin of the horizontal plane.

5. The method of superfinishing a Gothic-arch groove as defined in claim 1 further comprising determining the predetermined inclination angle and the center of the single circular arc comprising the steps of:

changing an inclination angle of the oscillation axis bit by bit;

calculating centers of approximate circular arcs and a circular arc approximate error of each groove cross section at each of the different inclination angles;

comparing the circular arc approximate errors at the different inclination angles to determine a minimum circular arc approximate error; and determining a center of the circular arc and an inclination angle which correspond to the determined minimum circular arc approximate error.

* * * * *